US005419680A

United States Patent [19]

Asano et al.

[11] Patent Number: 5,419,680

[45] Date of Patent: May 30, 1995

[54] MULTI-BLADE BLOWER

[75] Inventors: Hideo Asano, Gifu; Yasushi Kondo, Chiryu; Yukio Uemura, Kariya; Teruhiko Kameoka, Okazaki, all of Japan

[73] Assignee: Nippondenso Co., Ltd., Kariya, Japan

[21] Appl. No.: 156,782

[22] Filed: Nov. 24, 1993

[30] Foreign Application Priority Data

Nov. 25, 1992 [JP] Japan ..... 4-314952

[51] Int. Cl.[6] ..... F04D 17/04

[52] U.S. Cl. ..... 415/119

[58] Field of Search ..... 415/119, 206, 208.1

[56] References Cited

U.S. PATENT DOCUMENTS

| | | | |
|---|---|---|---|
| 2,037,940 | 4/1936 | Stalker | 415/119 |
| 3,477,635 | 11/1969 | Glucksman | 415/119 |
| 4,025,223 | 5/1977 | Anders et al. | 415/119 |
| 4,915,583 | 4/1990 | Vera et al. | 415/206 |
| 5,314,300 | 5/1994 | Gatley, Jr. et al. | 415/119 |
| 5,316,439 | 5/1994 | Gatley, Jr. et al. | 415/119 |

FOREIGN PATENT DOCUMENTS

| | | | |
|---|---|---|---|
| 0341553 | 11/1989 | European Pat. Off. | 415/119 |
| 0466983 | 1/1992 | European Pat. Off. | 415/119 |
| 0963809 | 7/1953 | Germany | 415/119 |
| 102467 | 7/1933 | Japan . | |
| 0118095 | 5/1987 | Japan | 415/119 |

*Primary Examiner*—Edward K. Look
*Assistant Examiner*—Mark Sgantzos
*Attorney, Agent, or Firm*—Cushman, Darby & Cushman

[57] ABSTRACT

A multi-blade blower with a reduced operating noise. The blower has a casing 3, inside of which a noise generator of a circular cross sectional shape is arranged at a position adjacent a throat of the scroll passageway. The noise generator has a radial gap S with respect to the outer edge of blade which is the same as a radial gap of the throat with the outer edge of the blade, and the spacing between the throat and the noise generator in the direction of the rotation of the wheel is 1.5 times of the blade pitch of the wheel.

2 Claims, 8 Drawing Sheets

MULTI-BLADE BLOWER

BACKGROUND OF THE INVENTION

1. Field of the Invention

The present invention relates to a multi-blade blower, provided with a scroll casing, which is suitable for use in an air conditioning apparatus for an automobile.

2. Description of Related Arts

In a multi-blade blower, a centrifugal blade wheel is provided in a scroll casing and a scroll passageway is created between the blade wheel and the casing, so that an air flow created by a rotation of the blade wheel is received by the scroll passageway. Such a multi-blade blower can produce a high air pressure and a large air flow, while the dimensions of the blower are small. Thus, this type of blower has a wide range of application such as in an air conditioning apparatus for an automobile and others.

In this type of blower, the scroll casing has a throat at a location where the scroll passageway commences between the scroll casing and the wheel, so that a throttle portion is created at the location of the throat, which causes a rapid change to be created in the pressure at the tongue, which causes a large pressure change to be created at the location of the throat due to the fact that free ends of the blades of the wheel pass by the opposite end of the throat during the rotation of the wheel, thereby producing a high level of operational noise.

In order to obviate the above mentioned drawback, the specification of Japanese Patent No. 102,467 discloses a blower where the throat is divided into two sections along the direction of the rotating axis of the blade wheel, which sections are, along the circumferential direction of the wheel, spaced for a length corresponding ½ of the blade pitch. In this arrangement in the prior art, pressure waves of different phases of ½ pitch are created when the blades of the wheel pass by the separated sections, respectively, so that the pressure waves of different phases to be canceled, thereby reducing the operating noise.

The scroll housing is formed with an axial air inlet of a bell mouth shape of the air and an air outlet which is tangential to the blade wheel. The rotation of the blade wheel causes the air to be sucked from the inlet and causes the sucked air to be discharged radially outwardly via the blades. The air flow radially discharged is collected in the housing and is discharged from the outlet. The prior art construction in '467 patent is, however, defective in its efficiently for decreasing an operating noise. Namely, in the prior art, the circumferentially spaced throat portions are provided so that they are axially divided. As well known, at a greater distance from the air inlet, the higher the speed of the discharged air flow. Thus, the noise levels (magnitude of the noise waves) are different from each of the blades passing by the circumferentially spaced throat portions at different axial positions. Thus, the canceling of the noise waves is not sufficient enough to fully reduced the noise. Namely, the noises generated at the separated sections of the throat are not fully canceled, resulting in an insufficient noise reduction performance.

SUMMARY OF THE INVENTION

An object of the present invention is to provide a multi-blade type blower capable of effectively reducing the noise generated by the rotation of the blade wheel.

According a first aspect of the present invention, a blower is provided, comprising:

a casing;

a centrifugal wheel having a base plate having an axis of a rotation and a plurality of blades fixed to the base plate and spaced circumferentially at a predetermined pitch;

the wheel being arranged in the casing so that a scroll passageway is created between an inner circumferential periphery of the casing and an outer circumferential periphery of the wheel;

the casing having an inlet opened axially to the wheel and an outlet opened substantially tangentially to the scroll passageway;

the casing defining a throat portion which is an origin of the scroll passageway in the direction of the rotation of the wheel; and, at least one interference noise generator arranged at a position adjacent the throat in the direction of the rotation of the wheel, so that a noise is generated when each blade passes by the noise generator during the rotation of the wheel;

said noise generator extending along an axial area which substantially conforms to an axial area along which the throat portion extends;

the spacing P between the throat and said at least one noise generator being such as to substantially satisfy the following equation;

$$P = p \times \left( n + \frac{m}{m+1} \right),$$

where n is an integer, and p is a blade pitch.

According a second aspect of the present invention, a blower is provided, comprising:

a casing;

a centrifugal wheel having a base plate having an axis of a rotation and a plurality of blades fixed to the base plate and spaced circumferentially at a predetermined pitch;

the wheel being arranged in the casing so that a scroll passageway is created between an inner circumferential periphery of the casing and an outer circumferential periphery of the wheel;

the casing having an inlet opened axially to the wheel and an outlet opened substantially tangentially to the scroll passageway;

the casing defining a throat portion which is an origin of the scroll passageway in the direction of the rotation of the wheel; and, at least one interference noise generator arranged in such a manner that a noise is generated when each blade passes by the noise generator during the rotation of the wheel;

said noise generator extending along an axial area which substantially conforms to an axial area along which the throat portion extends;

a position of the noise generator with respect to the throat is such that the noises of opposite phases are generated when the blades pass by the throat and the noise generator for canceling the noises.

According a third aspect of the present invention, a blower is provided, comprising:

a casing;

a centrifugal wheel having a base plate having an axis of a rotation and a plurality of blades fixed to the base plate and spaced circumferentially at a predetermined pitch;

the wheel being arranged in the casing so that a scroll passageway is created between an inner circumferential periphery of the casing and an outer circumferential periphery of the wheel;

the casing having an inlet opened axially to the wheel and an outlet opened substantially tangentially to the scroll passageway;

the casing defining a throat portion which is an origin of the scroll passageway in the direction of the rotation of the wheel; and, at least one interference noise generator extending axially throughout the width of the blades of the wheel and located on the same radius from the rotating axis as an inner surface of the throat;

the spacing between the throat and the noise generator in the direction of the rotation is such that noises of opposite phases are generated when the blades pass by the throat and the noise generator.

According to the present invention, a noise wave of a frequency determined by the rotational speed of the blade wheel and the number of the blades is created when the blades pass by the throat. Similarly, a noise wave of the same frequency is created when the blades pass by the noise generator. The arrangement is such that these noises have opposite phases, which allows the noise waves to cancel each other. According to the present invention, no division is made axially between the throat and the noise generator, and the throat as well as the noise generator extend axially under a desired relationship. Thus, the noise level is balanced along the axial direction. Namely, the noise levels generated from the throat and the noise generator are equalized, thereby suppressing the operational noise from the blower.

BRIEF DESCRIPTION OF ATTACHED DRAWINGS

DESCRIPTION OF PREFERRED EMBODIMENTS

Figure 1:
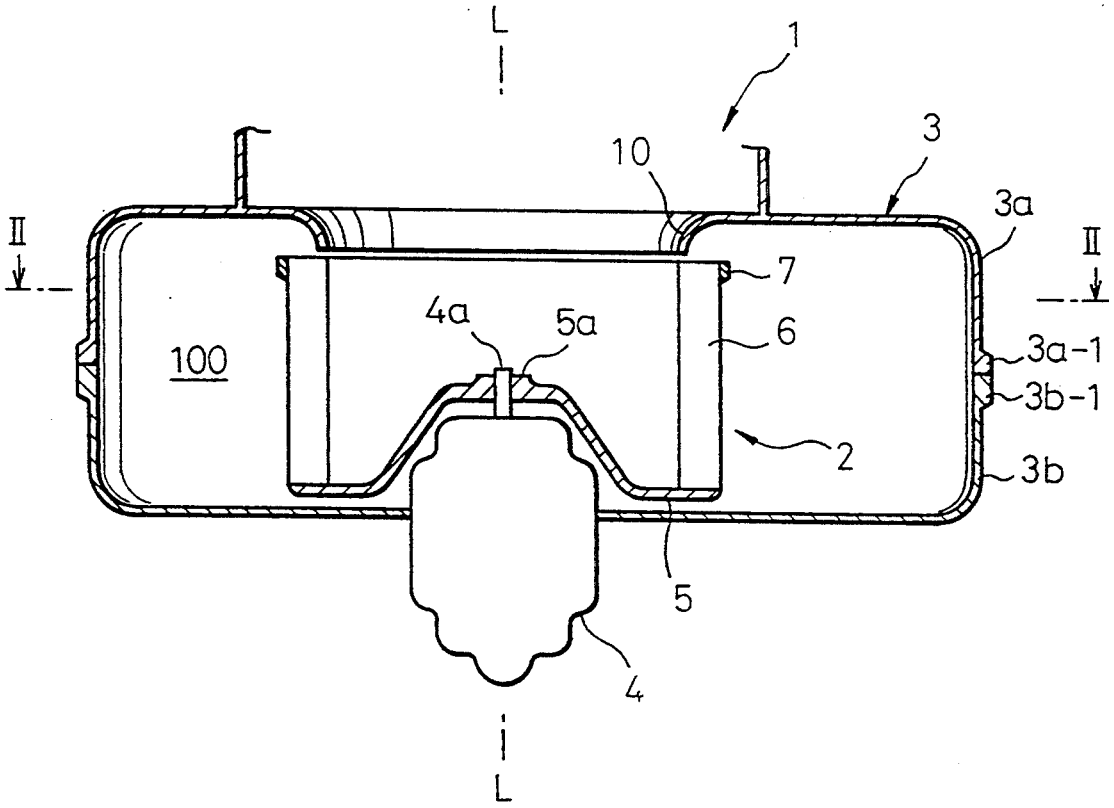
FIG. 1 is a axial sectional view of a multi-blade blower according to the present invention, taken along a line I—I in FIG. 3.
Figure 2:
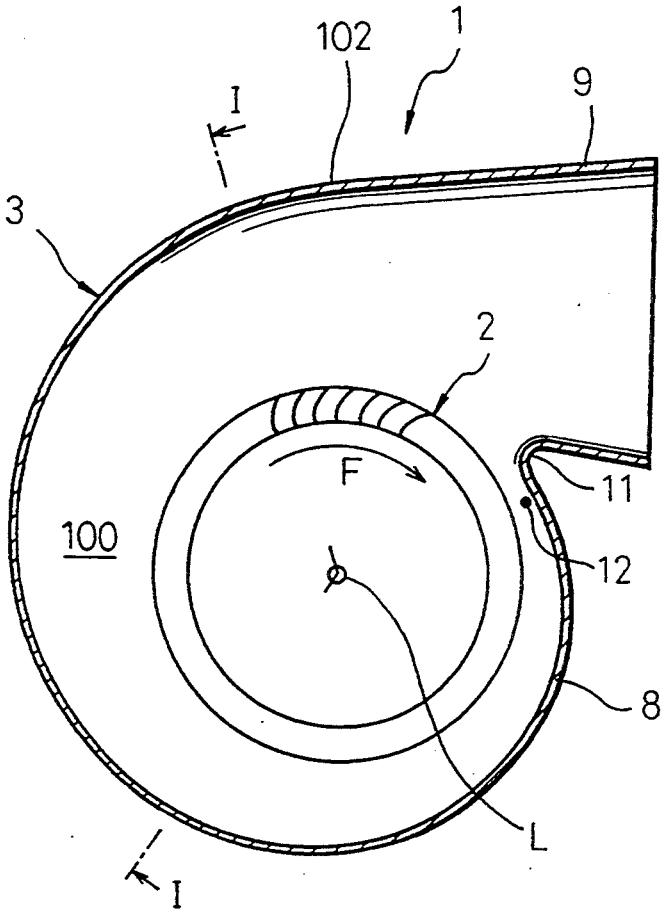
FIG. 2 is a transverse cross sectional view of the multi-blade blower, taken along a line II—II in FIG. 1.

In FIG. 1, reference numeral 1 generally denotes a multi-blade blower according to the present invention. The blower 1 includes a blade wheel assembly 2, a scroll casing 3 for storing therein the wheel 2, and an electric motor 4 for imparting a rotational movement to the wheel 2. The wheel assembly 2, which defines an axis L of rotation, is constructed by a bottom plate 5, plurality of equiangularly spaced blades 6 fixed on the bottom plate 5 along the circumference thereof as shown in FIG. 2, each blade 6 extending axially and having a bottom end fixed to the bottom plate 5 and a top end spaced from the plate 5, and a retainer ring 7 fixedly connected to the top ends of the blades 6. As shown in FIG. 1, the bottom plate 5 forms a central portion recessed axially, in which the motor 4 is neatly stored, which is advantageous in that the a projection of the housing of the motor 5 from the casing 3 is reduced. The recess portion forms a boss portion 5*a* to which a shaft 4*a* of the motor 4 is fixedly connected.

Figure 3:
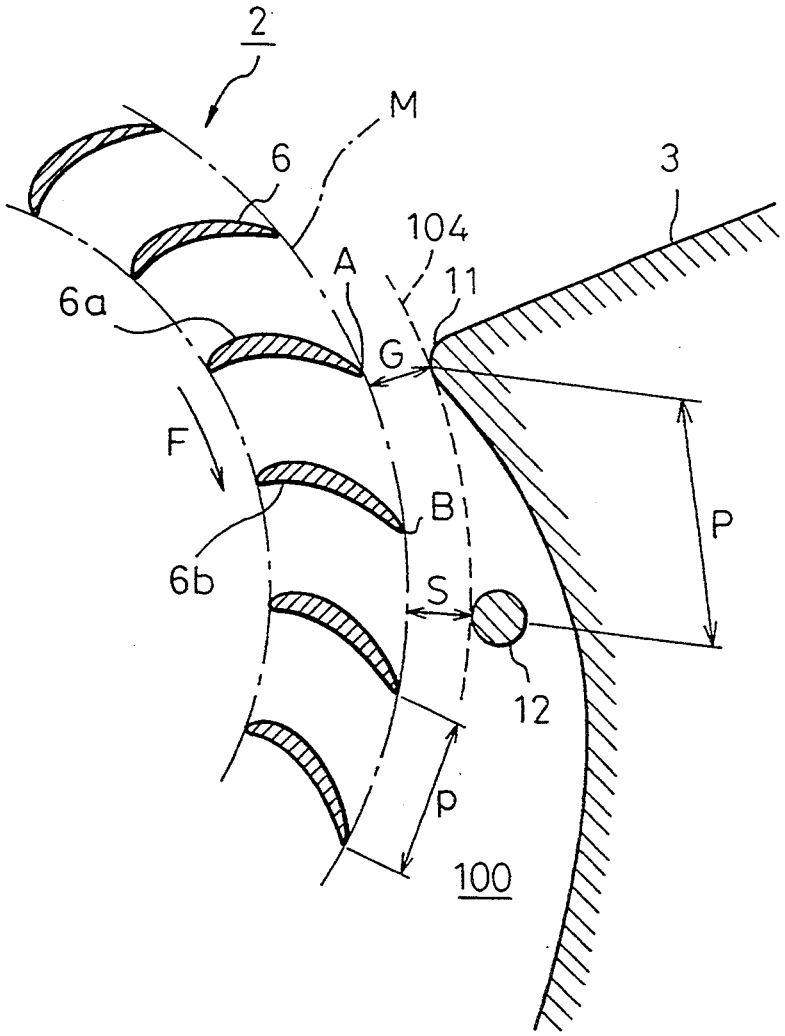
FIG. 3 is an enlarged view of a portion in FIG. 2 adjacent a throat portion.

As shown in FIG. 3, each blade 6 forms, along a plane transverse to the axis of the rotation L (FIG. 1), a close profile having first and second sections of substantially arc shape spaced in the direction of the rotation of the wheel as shown by an arrow F and extending radially while slightly inclined with respect to the direction F of the rotation of the wheel. The blades 6 extend along the direction of the rotating axis L, and are equiangularly spaced along the circumference of the wheel. The retainer ring 7, which connects the blades at their top ends, is for obtaining the fixed, equal circumferential spacing between the blades.

The casing 3 is for a formation of the scroll passageway 100 between the inner wall of the casing 3 and the wheel assembly 2. As shown in FIG. 2, the casing 3 defines a tubular body portion (scroll portion) 8 which is eccentric with respect to the wheel assembly 2, an outlet pipe portion 9 of an outwardly widened dimension which is connected to the tubular body portion 8 so that the outlet pipe portion is tangential to the wheel 2, and an inlet portion (bell mouth portion) 10 (FIG. 1) opened axially to the wheel 2. The casing 3 is produced from a mold of a resin, and is divided, along the axis L, into a first section 3*a* and a second section 3*b*. The first and second sections 3*a* and 3*b* form a pair of peripheral flanges 3*a*-1 and 3*b*-1, which are under a face to face contact condition and are fixedly connected with each other by suitable means. The upper casing 3*a* forms the bell mouth portion 10, while the lower casing 3*b* is for supporting the body of the motor 4.

The scroll portion 8 forms a throat 11 at a location at its inner circumferencial periphery of the smallest diameter from the axis L of the rotation of the wheel 2, i.e., at a location where the scroll passageway 100 is commenced in the direction F of the rotation of the wheel. The throat 11 extends along the direction of the axis of the rotation of the wheel 2, i.e., the entire width of the wheel 2. The scroll shape of the scroll portion 8 is such that a scroll shape of a constantly increasing area is obtained from the initial point (throat 11) of the scroll shape and the end point 102 of the scroll shape where the scroll portion 8 is connected to the outlet pipe portion 9.

As shown in FIG. 3, adjacent to the throat portion 11 but downstream therefrom in the direction F of the rotation of the wheel 2, a noise generator formed as a rod 12 of a circular cross section is arranged so that it extends across the scroll passageway 100 along the entire width of the blades 2. The noise generator rod 12 has axially spaced ends (not shown), at least one of which is fixed to the casing 3. The rod 12 may be integrally formed with the upper casing 3*a* or lower casing 3*b*. The rod 12 may, for example, extend from the upper casing 3*a* up to the lower casing 3*b*. In other words, the rod 12 extends axially parallel with respect to the throat portion 11, so that rod 12 has the same axial length as that of the throat portion 11.

As shown in FIG. 3, the interfering noise generator rod 12 is located so that it touches on its inner side with a radius line 104 which also touches the inner edge of the throat portion 11. Namely, the distance S of the rod 12 from the trajectory line M of the outer edges of the blades 6 during the rotation of the wheel 2 is equal to the distance G from the throat portion 11 from the same trajectory line M. In FIG. 3, the distance between the throat portion 11 and the interference noise generator rod 12 is shown by P.

The spacing P between the throat portion 11 and the interference noise generator rod 12 is obtained by the following equation, $$P = p \times \left( n + \frac{m}{m+1} \right), \tag{1}$$

where m is the number of the noise generators 12, n is an integer, and p is a blade pitch (distance between adjacent blades 6). In the first embodiment, m=1, and, thus, the spacing P becomes 1.5 times of the blade pitch p if it is assumed that n=1.

Now, the operation of the first embodiment will be explained. The rotating movement of the wheel 2 causes a noise to be generated every time an outer or free end of each blade 6 passes by the throat portion 11. The noise generated at the throat portion 11 during the rotational movement of the wheel 2 has a frequency f (Hz), which is expressed by $$f = N \times \frac{Z_n}{60}, \tag{2}$$

where N is the number of the rotation of the wheel 2 per minute (r.p.m), and $Z_n$ is the total number of the blades. Similarly, a noise is generated every time an outer free end of each blade 6 passes by the noise generator rod 12. Thus, as similar to the noise generated at the throat, the noise generated at the noise generator has the frequency expressed by the equation (2). The spacing P between the throat portion 11 and the noise generator 12 is 1.5 times of the blade pitch p. This means that, at an instant when an outer end (below, a blade end A) of a blade, for example, a blade **6*a* in FIG. 2, passes by the throat portion 11, another blade, for example, a blade 6*b* in FIG. 2, is located forwardly of the blade 6*a* in the direction of the rotational movement of the wheel as shown by the arrow F, so that an outer end (below, a blade end B) of the blade 6*b* is located rearward of the noise generator 12 for a length corresponding to a half of the blade pitch, $p_2$. Thus the time $t_1$ from the time when the blade end A passes by the throat 11, to the time when the blade end B passes by the noise generator 12 after the one half blade pitch rotation of the wheel 2**, is expressed by the following equation, $$\begin{aligned} t_1 &= \frac{\alpha}{\omega} \\ &= \frac{30}{N \times Z_n}, \end{aligned} \tag{3}$$

where α is an angle corresponding one half of the blade pitch, which is expressed by $$\alpha = \frac{2\pi}{2 \times Z_n} \tag{4}$$

and where ω is an angular velocity of the wheel 2, which is expressed by $$\omega = \frac{2\pi N}{60}. \tag{5}$$

The above equation of $t_1$ by the equation (3) means that, after the passage of the blade end A of the throat portion 11, the lapse time of $$t_1 = \frac{30}{N \times Z_n}$$

causes the blade end B to pass by the noise generator rod 12.

The wave length λ of the frequency (Hz) of $$f = N \times \frac{Z_n}{60}$$

is expressed by $$\begin{aligned} \lambda &= \frac{1}{f} \\ &= \frac{60}{Z_n}. \end{aligned} \tag{6}$$

Figure 4:
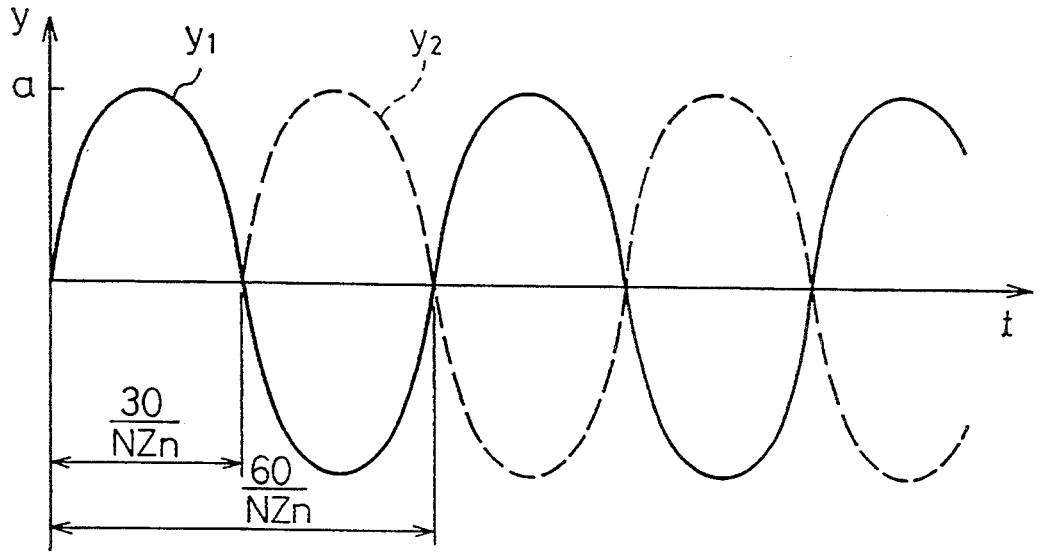
FIG. 4 shows wave forms of noises in the first embodiment.

Thus, from the equations (3) and (6), the time $t_1$ from the instant of the passage of the blade end A past the throat portion 11 to the instant of the passage of the blade end B past the noise generator 12 is one half of the wave length λ. Namely, $$t_1 = \frac{f}{2},$$

so that, irrespective of the number $Z_n$ of the blades 6, a symmetrical difference in the wave length is created between the noise $Y_1$ generated when the outer ends of the blades 6 pass by the throat portion 11 and the noise $Y_2$ generated when the outer ends of the blades pass by the noise generator rod 12, as shown in FIG. 4. The noise $Y_1$ generated when the blade end A passes by the throat portion 11 is expressed by the following equation.

$$Y_1 = a \times \sin(2\pi ft) \tag{7}$$

The noise $Y_2$ generated when the blade end B passes by the noise generator 12 is expressed by the following equation.

$$\begin{aligned} y_2 &= a \times \sin\{2\pi f(t - t_1)\} \\ &= a \times \sin\left\{2\pi f\left(t - \frac{30}{N \times Z_n}\right)\right\} \\ &= a \times \sin\left\{2\pi f\left(t - \frac{1}{2 \times f}\right)\right\} \\ &= a \times \sin(2\pi ft - \pi) \\ &= -a \times \sin(2\pi ft). \end{aligned} \tag{8}$$

The total noise y generated by the rotation of the wheel assembly is a summation of the noise $Y_1$ in the equation (7) and the noise $Y_2$ in the equation (8) and is $$y = y_1 + y_2 = a \times \sin(2\pi ft) - a \times \sin(2\pi ft) = 0.$$

Thus, from the view point of the mathematical calculation, the total noise is zero, which means that a reduction in the actual noise generated by the operation of the wheel will be obtained. In short, in the first embodiment, an opposite difference in the phases is obtained between end A of the throat 11 and the noise (wave form $Y_1$) generated upon the passage of the blade end A of the throat 11 past the noise (wave form $Y_2$) generated upon the passage of the blade end B past the noise generator 12, which causes the noises generated at the throat 11 and the noise generator 12 to cancel each other, thereby reducing the noise generated by the rotation of the wheel assembly 2.

In the blower of the first embodiment, the throat portion 11 as well as the interference noise generator 12 which are spaced circumferentially at a desired relationship extend axially without being axially divided. Thus, in comparison with the prior art where the throat is divided along the rotating axis, a reduction in the noise by an interference of noises of the same amplitude and of the different phases can be obtained without being influenced by a non uniform distribution of the air flow velocity generated by each of the blades along the rotating axis.

Figure 5:
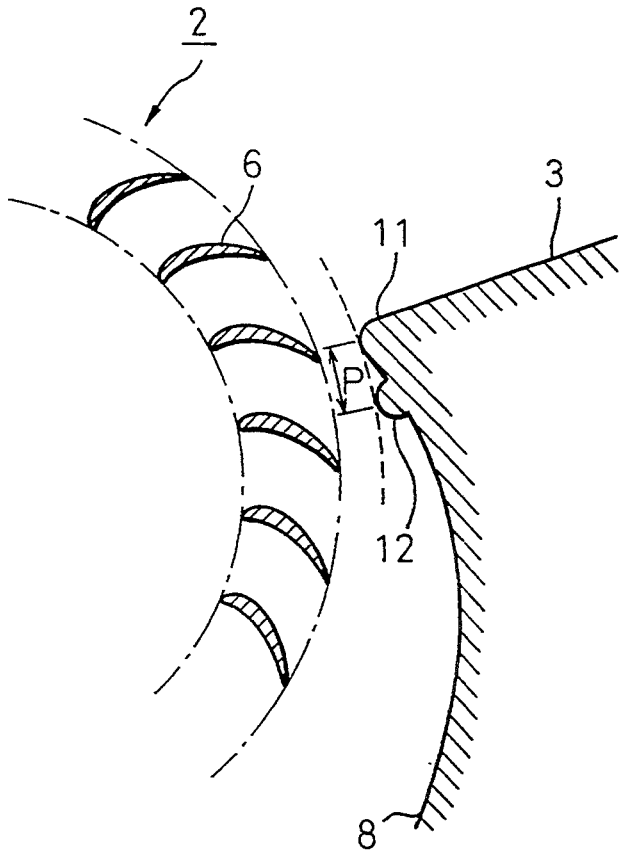
FIGS. 5 and 6 are similar to FIG. 3, but illustrate a second and third embodiment, respectively.

A second embodiment will be explained with reference to FIG. 5. In the second embodiment, the scroll portion 8 is provided, on an inner circumferential peripheral wall, a projection extending along the rotating axis for creating the interference noise generator 12. The distance of the noise generator 12 from the axis of the rotation of the wheel 2 as well as the spacing E of the noise generator 12 from the throat portion 11 are similarly determined with those in the first embodiment.

Figure 6:
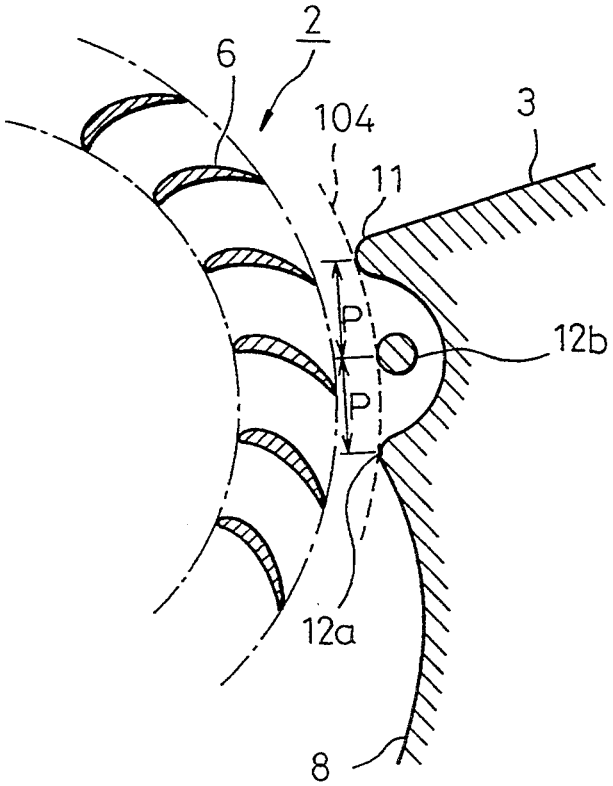

A third embodiment is shown in FIG. 6, where, adjacent the throat portion 11, the inner wall of the scroll portion 8 defines a recess of semi-circular cross sectional shape extending along the axis of the rotation of the wheel 2, so that a projected portion **12*a* functioning as a noise generator is created at a location spaced from the throat portion 11 in the direction of the rotation of the wheel 2. Furthermore, a second noise generator 12*b* formed as a rod extending parallel along the rotating axis of the wheel 2 is provided. As similar to the previous embodiments, the throat 11 and the noise generator 12*a* and 12*b* are located, so that the first and second noise generators 12*a* and 12*b* are inscribed with the circle 104 inscribed with the throat portion 11. The spacing between the throat 11 and the second noise generator 12*b* and the spacing between the second noise generator 12*b* and the first noise generator is the same value P, which is determined by the same equation (1) in the first embodiment. Namely, in this embodiment, two noise generators 12*a* and 12*b*** are provided (m=2), the spacing P is $2p_3$, when n=0.

Figure 7:
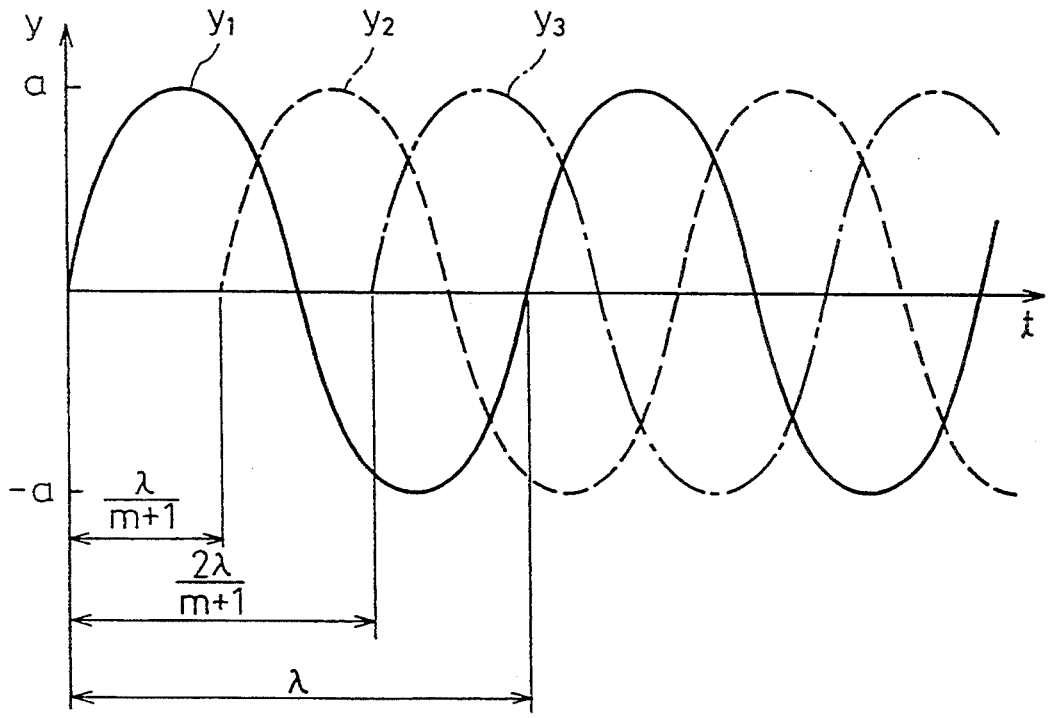
FIG. 7 shows wave forms of noises in the third embodiment.

FIG. 7 shows a noise wave $Y_1$ which is generated when an outer peripheral end of each of the blades 6 passes by the throat 11, a noise wave $Y_2$ which is generated when the outer peripheral end of each of the blades 6 passes by the noise generator **12*b*, and a noise wave $Y_3$ which is generated when the outer peripheral end of each of the blades 6 passes by the noise generator 12*a***.

The waves $Y_1$, $Y_2$ and $Y_3$ are expressed by the following equations.

$$Y_1 = a \times \sin(2\pi ft) \quad (9).$$

The noise $Y_2$ generated when the blade end B passes by the noise generator 12 is expressed by the following equation.

$$y_2 = a \times \sin\left\{2\pi f\left(t - \frac{\lambda}{3}\right)\right\} \quad (10)$$

$$y_3 = a \times \sin\left\{2\pi f\left(t - \frac{2\lambda}{3}\right)\right\} \quad (11)$$

These waves $Y_1$, $Y_2$ and $Y_3$ are combined, while considering $\lambda = 1/f$, so that:

$$\begin{aligned} y &= y_1 + y_2 + y_3 \\ &= a \times \left\{\sin(2\pi ft) + \sin\left(2\pi ft - \frac{2\pi}{3}\right) + \sin\left(2\pi ft - \frac{4\pi}{3}\right)\right\} \end{aligned} \quad (12)$$

As is well known, $$\sin\alpha + \sin\beta = 2 \times \sin\left(\frac{\alpha+\beta}{2}\right) \times \cos\left(\frac{\alpha-\beta}{2}\right) \quad (13)$$

In view of the equation (13), the first and the third terms in the equation (12) becomes:

$$\sin(2\pi ft) + \sin\left(2\pi ft - \frac{4\pi}{3}\right) = 2 \times \sin\left(2\pi ft - \frac{2\pi}{3}\right) \times \cos\left(\frac{2\pi}{3}\right) = -\sin\left(2\pi ft - \frac{2\pi}{3}\right), \text{ due to the fact that } \cos\left(\frac{2\pi}{3}\right) = -\frac{1}{2}$$

Thus, the above equation (12) becomes Y=0. This means that a summation of the waves $Y_1$, $Y_2$ and $Y_3$ becomes zero, so that a reduction in the noise is obtained.

Now, a noise reduction operation will be explained when the number of the noise generator, is m. Namely, the noise wave which is generated when each of the blades 6 passes by the m-th interference noise generator 12 is expressed by $$y_{m+1} = a \times \sin\left\{2\pi f\left(t + \frac{m\lambda}{m+1}\right)\right\} \quad (14)$$

Thus, a summation of all of the waves $Y_1$ to $Y_{m+1}$ generated when the blades of the wheel pass by the throat and the noise generators is expressed by the following equation.

$$\sum_{i=1}^{m+1} y_i = \sum_{i=0}^{m} a \times \sin\left\{2\pi f\left(t - \frac{i}{m+1}\lambda\right)y_i\right\} \quad (15)$$

In view of the following formula as to a summation of triangle functions, $$\sum_{i=0}^{m} a \times \sin(x + iy) = \frac{\sin\left(x + \frac{m}{2}y\right) \times \sin\left(x + \frac{m+1}{2}y\right)}{\sin\frac{y}{2}},$$

the equation (15) leads to $$\sum_{i=1}^{m+1} y_i = \sum_{i=0}^{m} a \times \sin\left\{2\pi ft + \frac{i}{m+1} \times (-2\pi)\right\} =$$

$$a \times \frac{\sin\left(2\pi ft + \frac{m}{2} \times \frac{-2\pi}{m+1}\right) \times \frac{\sin\left(m + 1 - \frac{-2\pi}{m+1}\right)}{2}}{\sin\frac{\frac{-2\pi}{m+1}}{2}} =$$

$$a \times \frac{\sin\left(2\pi ft - \frac{m}{m+1}\pi\right) \times \sin(-\pi)}{\sin\left(\frac{-\pi}{m+1}\right)} = 0$$

Thus, from the view point of pure mathematical calculation, the summation of the all of the noises $Y_1$ to $Y_{m+1}$ becomes zero, so that the operating noise is canceled. In short, when the number of the noise generators is m, the determination of the spacing P between the throat 11 and the noise generators 12 in accordance with the equation (1) allows the rotating noise to be reduced by combining the wave forms of the number of m+1.

Figure 8:
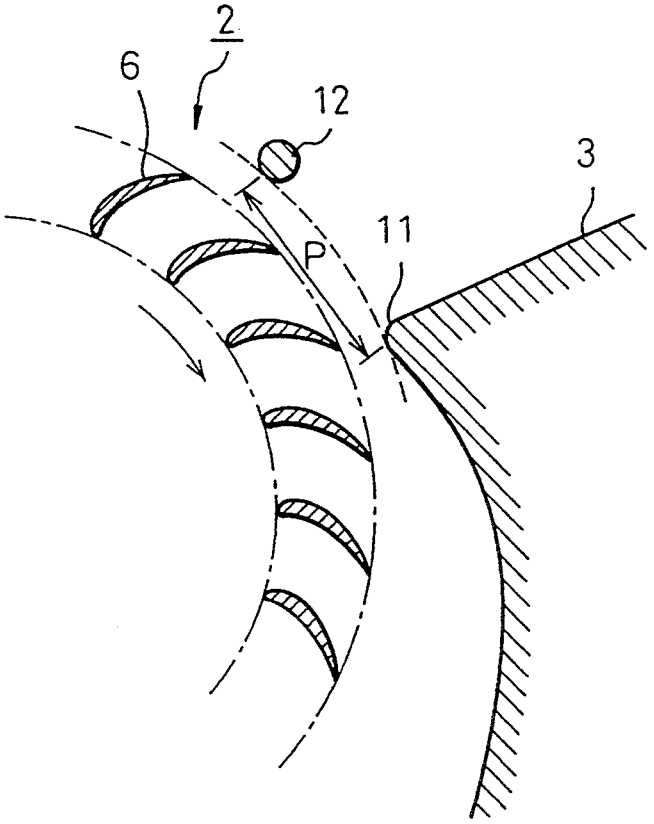
FIG. 8 is also similar to FIG. 3, but illustrates a fourth embodiment.

FIG. 8 shows a fourth embodiment, wherein the noise generator 12 is located upstream from the throat portion 11 in the direction of the rotation of the wheel 2. The spacing P determined in accordance with the above equation (1) can obtain a effect to cancel the operating noises generated at the throat and the noise generator.

In the above embodiments, the noise generator 12 has a circular cross sectional shape. However, the noise generator 12 can have a cross sectional shape, such as an elliptic shape, other than the circular cross section, which can provide a smooth flow of the air around the noise generator.

We claim:

1. A blower comprising:

a casing;

a centrifugal wheel having a base plate having an axis of a rotation and a plurality of blades fixed to the base plate and spaced circumferentially at a predetermined pitch;

the wheel being arranged in the casing so that a scroll passageway is created between an inner circumferential periphery of the casing and an outer circumferential periphery of the wheel;

the casing having an inlet opened axially to the wheel and an outlet opened substantially tangentially to the scroll passageway;

the casing defining a throat portion extending axially which is an origin of the scroll passageway in the direction of the rotation of the wheel; and at least one interference noise generator arranged at a position adjacent the throat in the direction of the rotation of the wheel and at the same radial distance from the axis of rotation as an inner surface of the throat, so that noise is generated when each blade passes by the noise generator during the rotation of the wheel;

said noise generator extending along an axial area which substantially conforms to an axial area along which the throat portion extends so that the noise generator and the throat have substantially the same axial length;

a spacing P between the throat and said at least one noise generator being such as to substantially satisfy the following equation;

$$P = p \times \left(n + \frac{m}{m+1}\right)$$

where n is an integer, p is a blade pitch, and m is the number of noise generators.

2. A blower comprising:

a casing;

a centrifugal wheel having a base plate having an axis of a rotation and a plurality of blades fixed to the base plate and spaced circumferentially at a predetermined pitch;

the wheel being arranged in the casing so that a scroll passageway is created between an inner circumferential periphery of the casing and an outer circumferential periphery of the wheel;

the casing having an inlet opened axially to the wheel and an outlet opened substantially tangentially to the scroll passageway;

the casing defining a throat portion extending axially which is an origin of the scroll passageway in the direction of the rotation of the wheel; and, at least one interference noise generator arranged at a position adjacent the throat and at the same radial distance from the axis of rotation as an inner surface of the throat, such that a first noise is generated when each blade passes by the throat and a second noise is generated when each blade passes by the noise generator during the rotation of the wheel;

said noise generator extending along an axial area which substantially conforms to an axial area along which the throat portion extends so that the noise generator and the throat have substantially the same axial length;

the noise generator being positioned with respect to the throat such that the first and second noises are of opposite phase and cancel each other.

* * * * *